US005279090A

United States Patent [19]

Yamaguchi et al.

[11] Patent Number: 5,279,090

[45] Date of Patent: Jan. 18, 1994

[54] CEILING-FRAME CONSTRUCTION METHOD AND CEILING-FRAME STRUCTURE FOR CLEAN ROOMS

[75] Inventors: Shigehisa Yamaguchi, Yokohama; Yoshiaki Kashiwase, Funabashi; Kazutomo Isono, Tokyo; Hiroshi Kagoyama, Chiba, all of Japan

[73] Assignees: Asahi Kogyosha Co., Ltd.; Nippon Donaldson Ltd., both of Tokyo, Japan

[21] Appl. No.: 851,635

[22] Filed: Mar. 16, 1992

[30] Foreign Application Priority Data

Mar. 18, 1991 [JP] Japan ..... 3-15661[U]
Mar. 18, 1991 [JP] Japan ..... 3-52559

[51] Int. Cl.[5] ..... E06B 3/54

[52] U.S. Cl. ..... 52/484; 52/665; 454/292; 454/187; 55/355

[58] Field of Search ..... 52/39, 484, 485, 487, 52/489, 665; 55/355, 385; 454/187, 292, 293, 296

[56] References Cited

U.S. PATENT DOCUMENTS

| | | | |
|---|---|---|---|
| 3,417,530 | 12/1968 | Long | 52/484 X |
| 3,708,927 | 1/1973 | Cohen | 52/484 X |
| 3,848,385 | 11/1974 | Thompson | 52/484 X |
| 4,088,463 | 5/1978 | Smith | 454/292 X |
| 4,344,784 | 8/1982 | Deckas et al. | 55/484 X |
| 4,671,811 | 6/1987 | Cadwell, Jr. et al. | 52/484 X |
| 4,769,958 | 9/1988 | Limp | 52/484 X |
| 4,946,484 | 8/1990 | Monson et al. | 454/187 X |
| 4,976,757 | 12/1990 | Helmus | 55/355 |
| 5,077,951 | 1/1992 | Baker | 52/484 |

*Primary Examiner*—Carl D. Friedman
*Assistant Examiner*—Kien Nguyen
*Attorney, Agent, or Firm*—Harness, Dickey & Pierce

[57] ABSTRACT

In a method of constructing a ceiling frame to support a filter at the ceiling of a clean room, the method is characterized in that a number of divisional frame units are formed, each in a rectangular frame, to frame a filter unit to be installed, that those divisional frame units are positioned one after another at the ceiling of the clean room, that the ceiling frame is formed by connecting, to unify, abutting frame members of the divisional frame units, and that the divisional frame units are hanged at the ceiling with hangers applied at the abutting portions of the divisional frame units.

21 Claims, 9 Drawing Sheets

CEILING-FRAME CONSTRUCTION METHOD AND CEILING-FRAME STRUCTURE FOR CLEAN ROOMS

BACKGROUND OF THE INVENTION

1. Technical Field

The present invention relates to a construction method and structure of ceiling frames used in clean rooms to support filters at the upper portion of the clean rooms.

2. Technical Background

Generally, clean rooms are formed with, at their upper portion, an air-supply chamber to discharge the air cleaned through a filter and, at their lower portion, an air-circulation chamber to recover the clean air through a grating, etc. The clean air blowing out of the air-supply chamber through a filter into the main room of the clean room descends in the room and is swallowed into the air-circulation chamber, and the air is circulated into the clean room again.

When constructing a clean room, especially when installing a blower having a filter or installing only a filter, a ceiling frame is applied to extend longitudinally and transversely at the ceiling, and then each blower unit or each piece of the filter is paneled into each of the spaces defined by the frame.

However, while those blower units with a filter or those pieces of the filter are fabricated in certain standard dimensions at a factory, it is necessary for parts of the ceiling frame to be adjusted in their dimensions at the construction site and to be assembled to receive those blower units or filter units, resulting in a problem of terrible construction inefficiency.

SUMMARY OF THE INVENTION

It is an object of the present invention to provide a ceiling-frame construction-method and a ceiling-frame structure which enable an easy assembly of a ceiling frame with precision for clean rooms.

It is another object of the present invention to provide a fixture-fixable ceiling frame structure to allow the placement of fixtures such as fluorescent lamps to the ceiling frame.

In a method of constructing a ceiling frame to support a filter at the ceiling of clean rooms, the ceiling-frame construction method according to one aspect of the present invention comprises the steps of forming a number of divisional frame units, each in a rectangular frame to frame each filter unit to be installed, positioning those divisional frame units one by one at the ceiling, connecting adjacent divisional-frame units to one another to form the whole ceiling frame, and hanging the divisional frame units from the ceiling with hangers applied at the corners of their abutting portions.

Also, in a ceiling-frame structure to support a filter at the ceiling of clean rooms, the ceiling-frame structure for clean rooms according to another aspect of the present invention comprises a divisional frame unit formed in a rectangular frame to frame a filter unit to be installed and having an abutting surface face on its outer edges, a connection groove formed in each frame member of the divisional frame unit, a joint piece to connect abutting divisional frame units to one another by engaging itself in the connection grooves of a pair of abutting divisional frame units when the divisional frame units are positioned to form the whole ceiling frame, and a hanger applied at the corners of abutting divisional frame units to hang the divisional frame units positioned at the ceiling.

In a fixture-fixable ceiling-frame structure to allow the placement of fixtures such as fluorescent lamps at the lower portion of the ceiling frame supporting the filter used for the clean room, the fixture-fixable ceiling-frame structure according to yet another aspect of the present invention includes a divisional frame unit formed in a rectangular frame structure to frame a filter unit of the filter and positioned and hanged in plurality at the ceiling to form a unified ceiling frame, a connection groove formed at the lower portion of each frame member of the divisional frame unit for a joint piece to be inserted for connecting the divisional frame units to one another, and a hook to sustain fixtures such as fluorescent lamps by fitting into and engaging itself to the connection grooves formed between abutting divisional frame units when they are positioned.

According to the present invention, when assembling a ceiling frame at the ceiling of a clean room, the ceiling frame can be easily assembled with accuracy by forming beforehand at a factory, etc., divisional frame units having predetermined dimensions to allow the installation of filter units so that the divisional frame units are positioned one by one, connected as a whole at the construction site, and hanged at the ceiling with hangers.

DESCRIPTION OF THE PREFERRED EMBODIMENTS

Now, preferred embodiments according to the present invention will be described in accordance with the attached drawings.

At first, the whole of the present invention will be generally described with reference to FIGS. 1 and 2.

Figure 1:
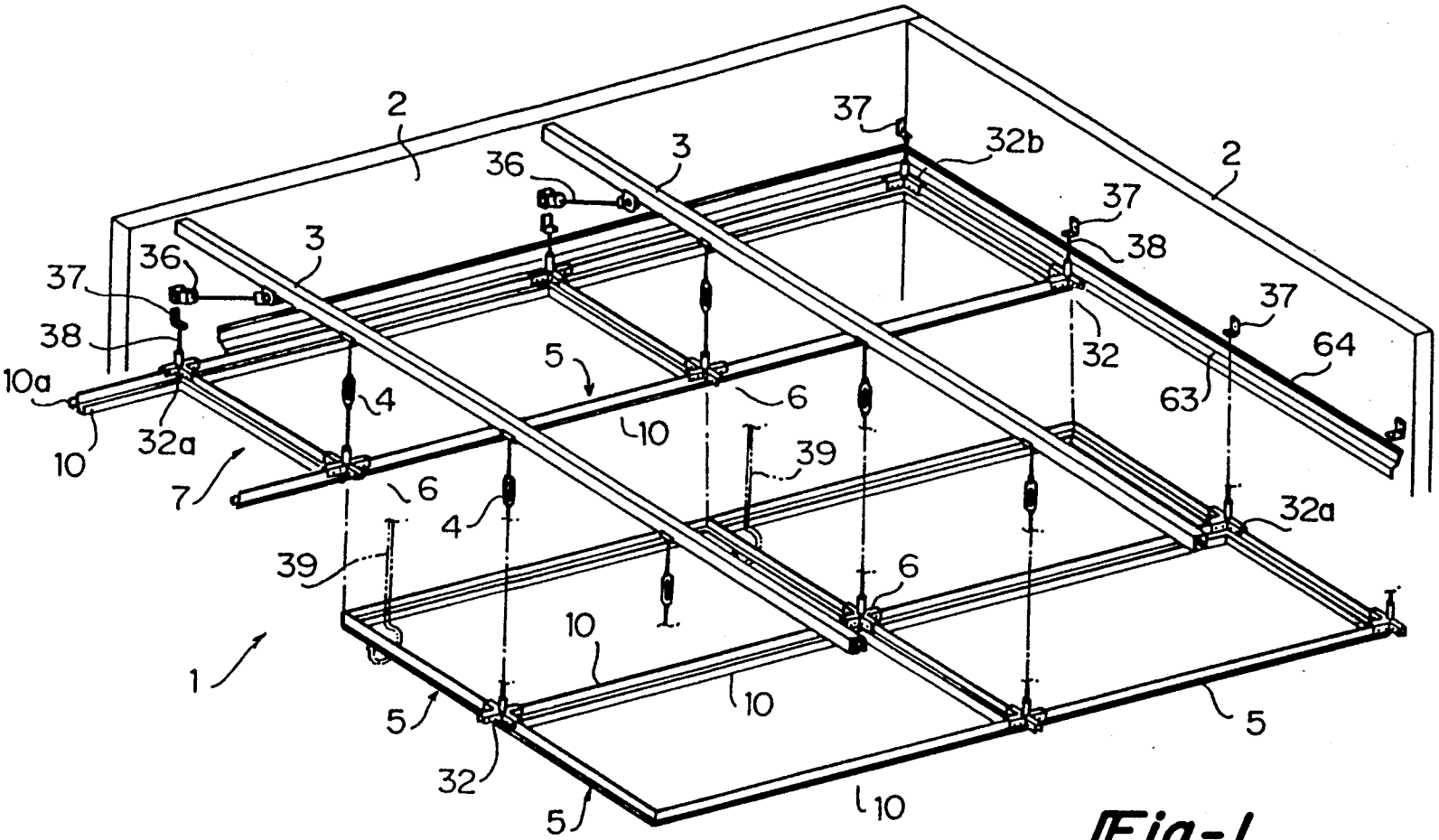
FIG. 1 is a perspective view showing the whole of one embodiment according to the present invention.

In FIG. 1, the numeral 1 denotes a clean room, the space of which is defined by partition boards 2. Raceways 3 are placed securely at the ceiling of the clean room 1, and a plurality of divisional frame units 5 each formed in a rectangular frame are positioned through turnbuckles 4 connected to the raceways 3, and then a ceiling frame 7 is created with those divisional frame units 5 abutted and hanged with hangers 6 applied at their corners.

Figure 2:
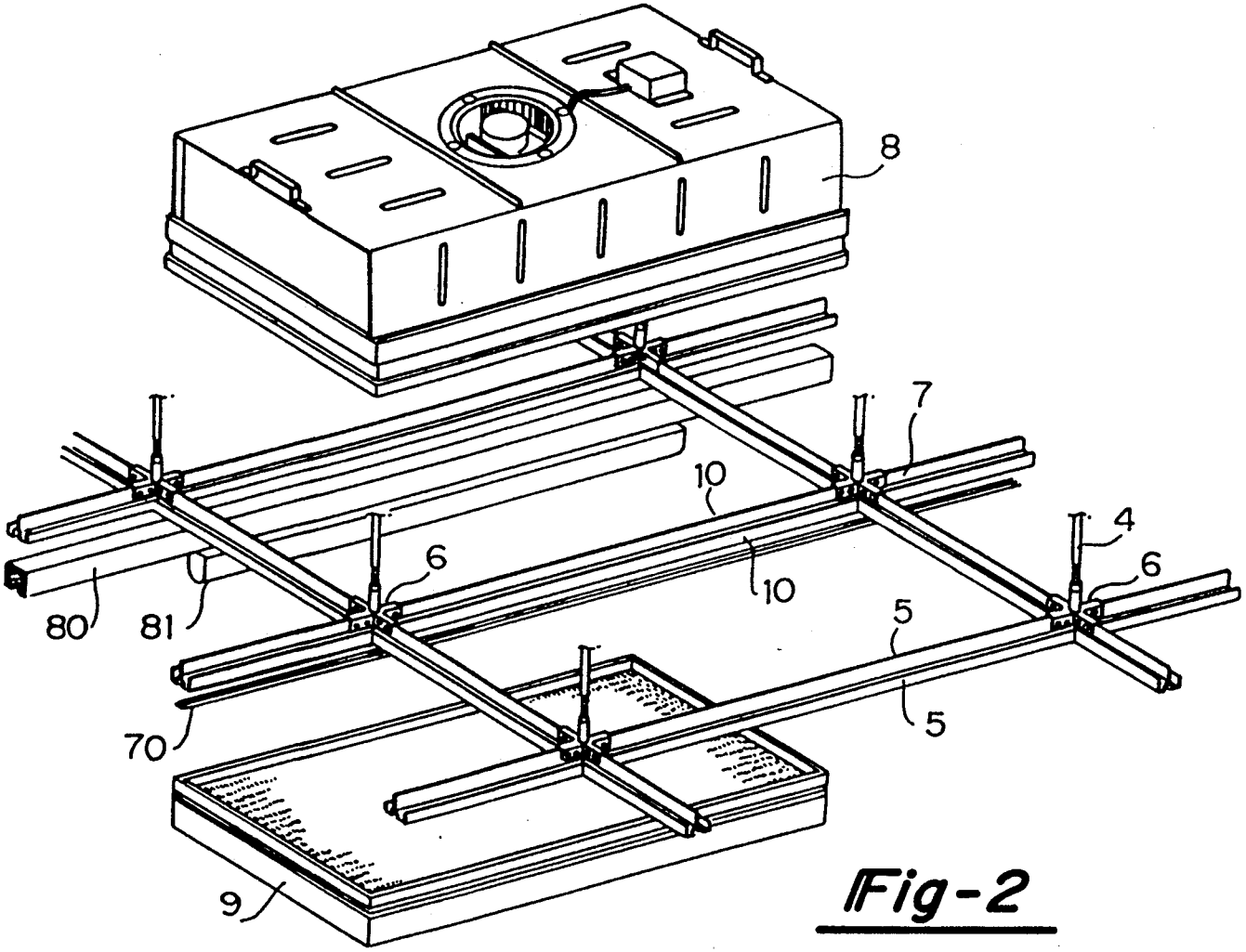
FIG. 2 is a perspective view showing the installation of a blower unit to the ceiling frame of the embodiment shown in FIG. 1.

After assembling the ceiling frame 7, a blower unit 8 is placed into each divisional frame unit 5 from above the ceiling frame 7 as seen in FIG. 2, and a filter unit 9 is fitted into each of the blower units 8 from blow. Though if preferred, only filter units 9 may be placed in this ceiling frame 7.

Now, the construction method and structure of this ceiling frame will be described more in detail in reference to FIGS. 3 through 12.

Figure 4:
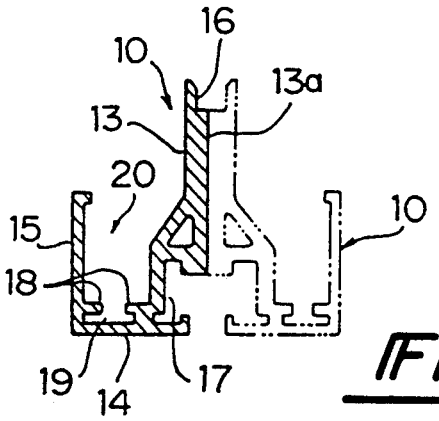
FIG. 4 is an enlarged sectional view taken along the line IV—IV of FIG. 3.
Figure 5:
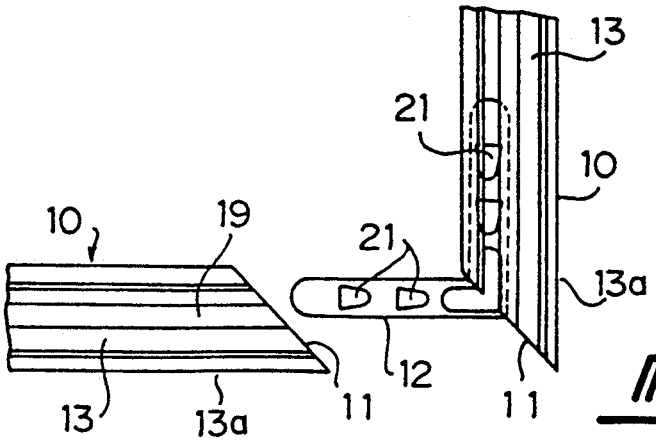
FIG. 5 is an enlarged view of an important part of the assembly of the divisional frame unit shown in FIg. 3.

In the first place, the divisional frame unit 5 is formed in a rectangular frame to frame the filter unit 9 shown in FIG. 2. This divisional frame unit 5 comprises of four frame members 10, each frame member having an identical sectional figure, as seen in FIGS. 4 and 5, with adjoining portions 11 at both ends, each end formed in a 45-degree cut. Those frame members 10 are positioned in a right angle to one another, adjoining the adjoining portions 11, and, at the same time, a clip 12 having a figure of the letter "L" is inserted into the adjoining portions 11, thus forming a rectangular frame body.

As seen in FIG. 4, the section of the frame member 10 is formed approximately in a figure of "L" having a support-plate portion 13, the outside of which forms an abutting surface 13*a*, a bottom-plate portion 14 extending inwards from the support-plate portion 13, and an inside-plate portion 15 hedging up from the bottom-plate portion 14. At the upper end of the support-plate portion 13, provided is a seal groove 16 used to seal up chinks existing between the abutting surfaces 13*a* when the frame member 10 is abutted as shown with another frame member 10 illustrated in a two-dot chain line, and, at the lower end, provided is a connection groove 17 used to connect two frame members 10 of the abutting divisional frame units 5 by receiving a joint piece 30 to unify the divisional frame units 5, which will be further described later. Also, above the bottom-plate portion 14, two nail strips 18 are formed, one on the support-plate portion 13 and the other on the inside-plate portion 15 to face each other. Below the nail strips 18, an engagement groove 19 is formed to engage the clip 12, and above the nail strips 18, a support channel 20 is formed to support the blower unit 8 or the filter unit 9 and to seal them with the frame member 10.

Figure 3:
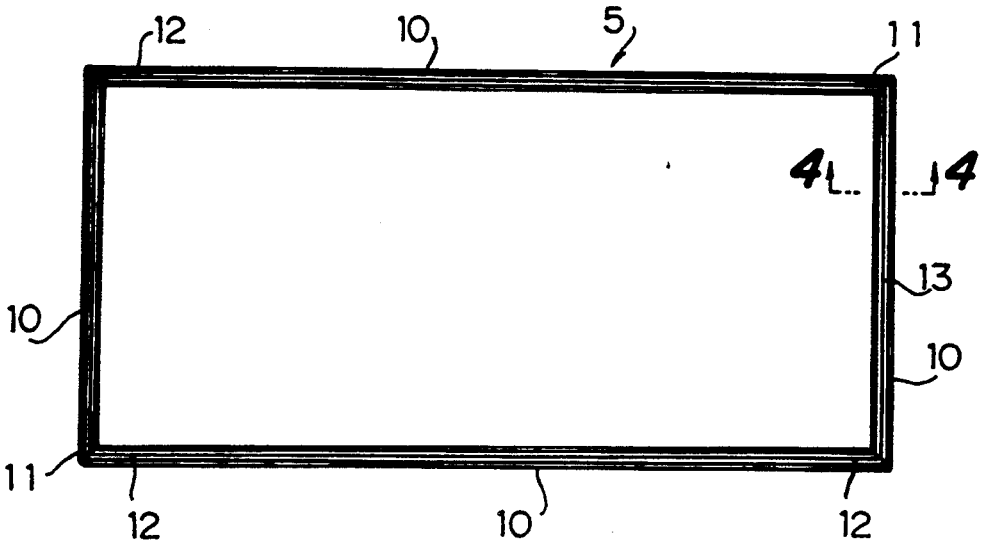
FIG. 3 is a plan view showing a divisional frame unit according to the present invention.

In assembling the divisional frame unit 5, one end of the clip 12 is inserted from the adjoining portion 11 into the engagement groove 19 of one of the frame members 10 as seen in FIG. 5, and the other end of the clip 12 is then inserted into the engagement groove 19 of another frame member 10. This process is repeated to make four corners to assemble the divisional frame unit 5 in a rectangular figure as seen in FIG. 3. The clip 12 has a plurality of sheared and raised tabs 21 to lock itself in the engagement grooves 19, but the clip 12 is easily removed out of the engagement grooves 19 just by pressing the tabs 21 with the end of a screwdriver, etc through the space between the nail stripes 18.

Now, the construction of the ceiling frame 7 with those divisional frame units 5 will be described referring to FIGS. 1 and 2 and FIGS. 6 through 12.

As seen in FIG. 1, the divisional frame unit 5 is hanged from the raceways 3 through turnbuckles 4 singularly or plurally, with other divisional frame units, e.g., in four units grouped in two lines and two rows, the corners of which units are connected to one another with hangers 6.

Figure 6:
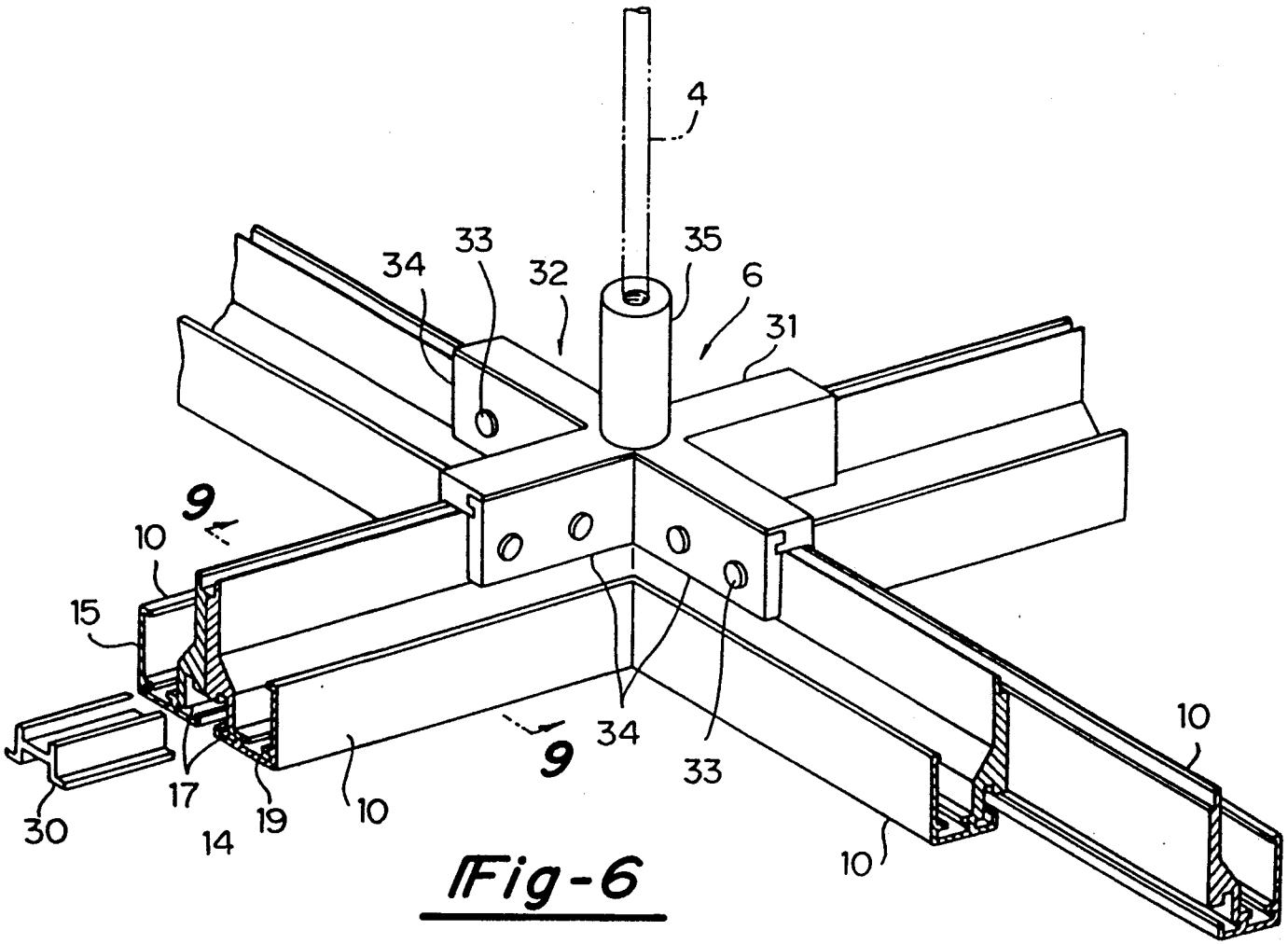
FIG. 6 is an enlarged perspective view of an important part of the abutting portions of the divisional frame units shown in FIG. 1.
Figure 7:
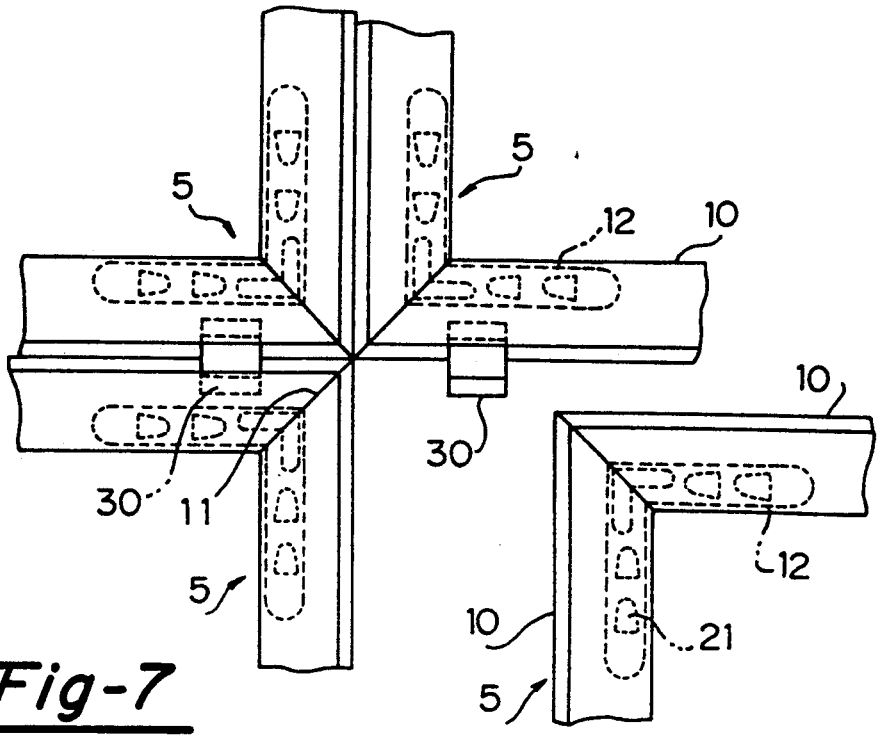
FIG. 7 is a bottom view showing the condition of connection of the divisional frame units shown in FIG. 6.
Figure 8:
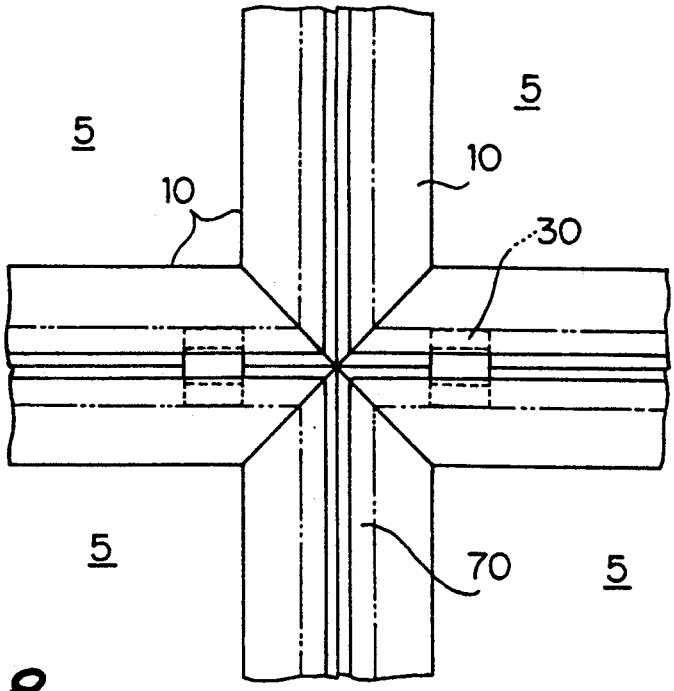
FIG. 8 is a bottom view of the part shown in FIG. 6.

At first, the frame members 10 of a divisional frame unit 5 abutting a frame member 10 of other divisional frame units 5 are connected to the abutting frame mamber 10, as seen in FIGS. 6 and 8, by abutting the support-plate portions 13 of both abutting frame members 10 to each other and fitting a joint piece 30 having a sectional figure of the letter "H" into the unified connection grooves 17 of both members 10. The fitting of the joint piece 30 may be carried out, as seen in FIG. 7, by fitting it into one of the frame members 10 and then by fitting this joint piece 30 into the connection groove 17 of the other member 10. Or, a hole may be provided through the bottom-plate portion 14 so that, through that hole, the joint piece 30 is fitted into the unified connection grooves 17. After the frame members 10 are abutted and connected, a liquid sealing agent 22 is applied into the seal grooves 16 formed and unified at the top of the support-plate portions 13 of the abutting frame members 10.

Figure 9:
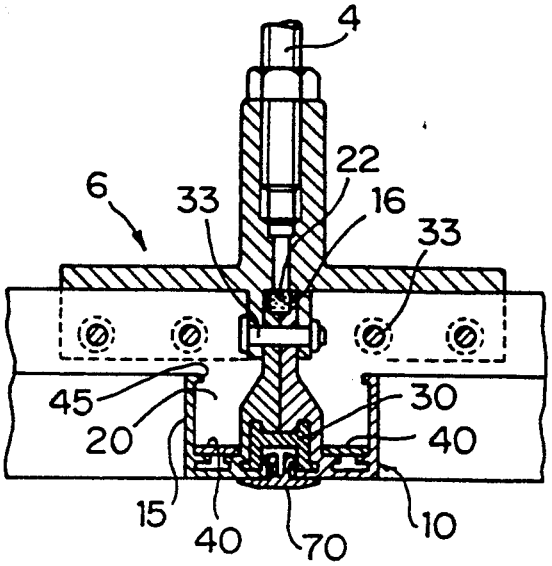
FIG. 9 is a sectional view taken along the line IX—IX of FIG. 6.
Figure 11:
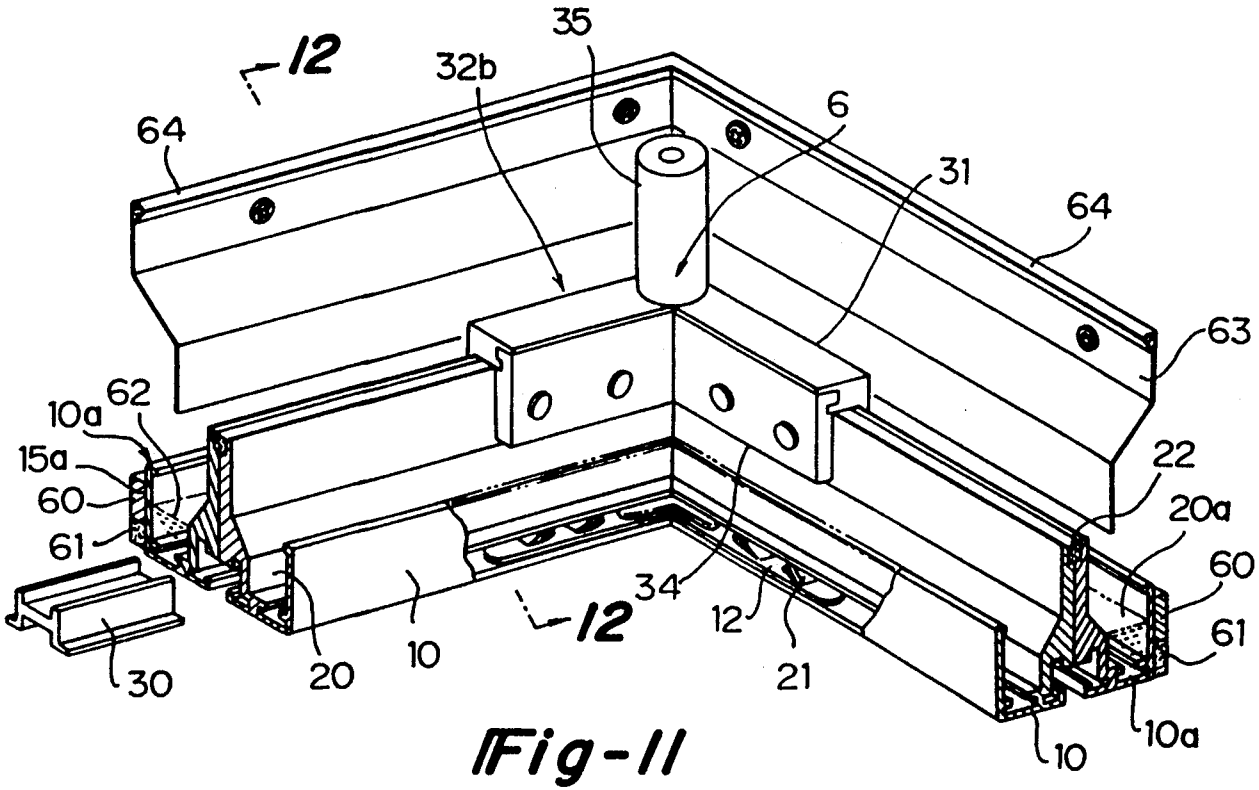
FIG. 11 is an enlarged perspective view of an important part of the ceiling frame according to the present invention at a corner of the clean room.

As seen in FIGS. 6 and 9, the hanger 6 includes a hanger body 32 having fixed joint plates 31, each plate having a sectional figure of the letter "L" and connected to the body 32 in a cross form, removable joint plates 34 provided each to face one of the fixed joint plates 31 and to be connected to it with rivets, etc. to bind the abutting support-plate portions 13 between each pair of the joint plates 31 and 34, and a cylindrical nut 35 formed extending upwards at the center of the hanger body 32 to engage the end of the turnbuckle 4 by means of thread. Besides the hanger 6 having the fixed joint plates 31 in a cross, for the use by the walls of the clean room 1, another hanger 6 having a hanger body 32*a* of a "T" form is applied to connect the divisional frame units 5 positioned by the walls as seen in FIG. 1, and yet another type of hanger 6 having a hanger body 32*b* of a "L" form is applied for the use at the corners of the clean room 1 as seen in FIGS. 1 and 11.

In positioning the divisional frame units 5 at the ceiling of the clean room 1, as seen in FIG. 1, at first, the raceways 3 are placed in parallel to one another with an interval of the same length as the long edge of the divisional frame unit 5, at the ceiling of the clean room 1, and the raceways 3 are held with supporters 36. Then, the hangers 6 are hanged from the raceways 3 with turnbuckles 4 while the long edge sides of the divisional frame units 5 are aligned one by one along one of the partition boards 2 and connected one after another. Before positioning those divisional frame units 5, however, seaming frame members 10*a* should be abutted to the frame members 10 to occupy the place adjacent to the partition boards 2, and they are also connected with the hangers of "T" and "L" forms. Where the supporters 36 are snags for the turnbuckles 4 to be applied to hang the hangers 6, a suspender 37 is mounted on the partition board 2, and a rod 38 is applied to freely adjust the height of the hanger 6 and to suspend it.

After positioning some of the divisional frame units 5 in a row along one of the partition boards 2 in the above described way, other divisional frame units 5 are aligned one by one along the long edges of the divisional frame units 5 already positioned in the first row, and the corners of the abutting units 5 are connected with the hangers 6 and hanged from the raceways 3.

For this process, if a plurality of divisional frame units 5 are grouped and connected together on the floor and temporary hooks 39 are applied to them to hook the grouped frame units 5 temporarily to the raceways 3, then it will be easy for the turnbuckles 4 to be connected and also for the height of the units 5 to be adjusted.

Figure 10:
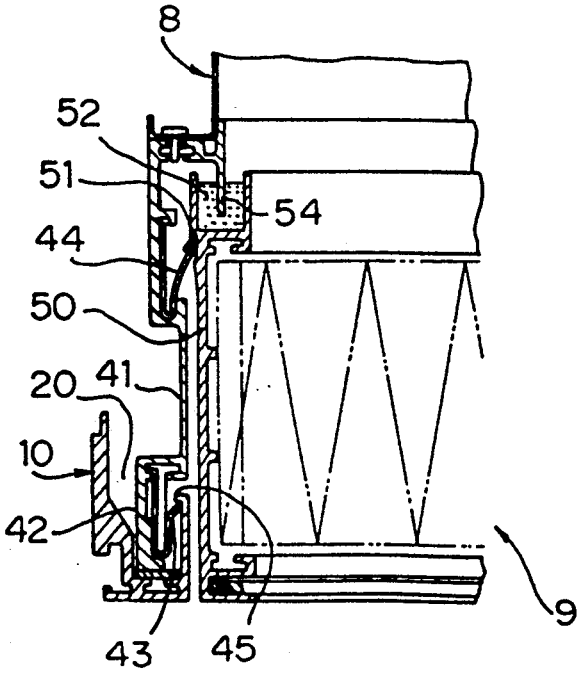
FIG. 10 is a sectional view of an important part in the condition that a blower unit is installed on the divisional frame unit according to the present invention.

After the ceiling frame 7 is constructed in such a way, each blower unit 8 is passed through the opening of each divisional frame unit 5 and positioned on the ceiling frame 7 as seen in FIG. 2, and then the blower unit 8 is fitted into the divisional frame unit 5. When this process is carried out, a gasket 40 is fitted into the support channel 20 of each frame member 10 of the divisional frame unit 5 as seen in FIG. 9, and the blower unit 8 is mounted in a manner that the lower end 42 of the casing 41 of the blower unit 8 is seated on the gasket 40, as seen in FIG. 10. A stop strip 45 is formed at the upper end of the inside-plate portion 15 of the frame member 10, and a plate spring 43, which is provided to extend inwards and upwards from the end of the inner rim at the lower end 42 of the casing 41, engages the stop strip 45 when the blower unit 8 is installed, thus preventing the blower unit 8 from sliding upwards.

After the blower unit 8 is installed in the divisional frame unit 5, a filter unit 9 is installed in the blower unit 8. The installation of the filter unit 9 into the blower unit 8 is carried out, as seen in FIG. 10, by inserting the filter unit 9 into the casing 41 of the blower unit 8 and seating a stepped-up portion 51, formed around the outer surface of the filter case 50 of the filter unit 9, on the upper end of the support spring 44 provided to extend inwards and upwards around the inside of the casing 41 of the blower unit 8. Upon its installation, the filter unit 9 is sealed with the blower unit 8 because a seal strip 54 provided to the casing 41 of the blower unit 8 submerges into a seal tank 52 formed at the upper portion of the filter case 50.

Although the drawings show a case of the installation of blower units 8 having a filter unit, only filter units may be installed. In such a case, the lower end of the filter case 50 can be formed to be sealed with and inserted into the support channel 20.

Now, the seal between the divisional frame units 5 and the partition boards 2 of the clean room 1 will be described in accordance with FIGS. 11 and 12.

Figure 12:
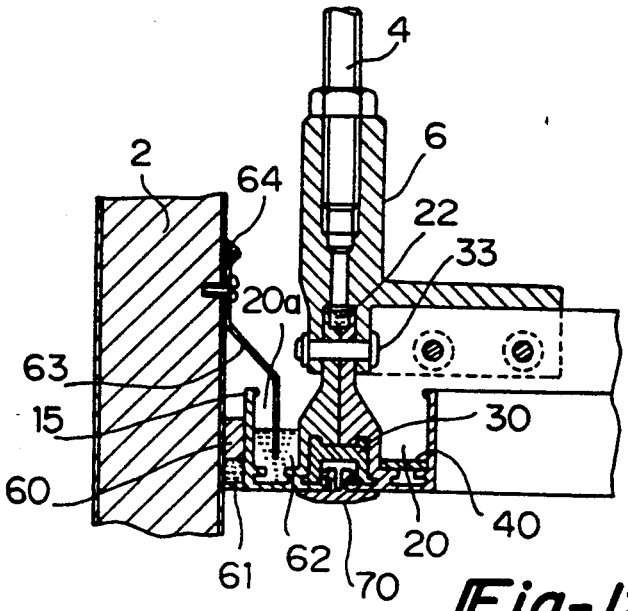
FIG. 12 is a sectional view taken along line XII—XII of FIG. 11.

As seen in FIGS. 11 and 12, a seaming frame member 10*a* is abutted to the frame member 10, of the divisional frame unit 5, adjacent to the partition boards 2. A backup member 60 is provided to the inside-plate portion 15*a* of this seaming frame member 10*a*, and beneath the backup member 60, provided is a silicone seal 61 to seal with the partition board 2. Furthermore, the support channel 20*a* of the seaming frame member 10*a* is filled with a silicone sealant 62, and a wall plate 63 is provided on the partition board 2 so that, when the seaming frame member 10*a* is positioned, the lower end of the wall plate 63 plunges into the silicone sealant 62. A silicone sealant 64 is also applied between the upper portion of the wall plate 63 and the partition board 2.

Also, as seen in FIGS. 2, 8, 9, and 12, a slit cover 70 is applied to be inserted and fixed in the clearance between the bottom-plate portions 14 of the abutting divisional units 5 to cover up the fissure at the bottom of the abutting frame members 10. Or, as seen in FIG. 2, the clearance existing at the lower portion of the abutting frame members 10 is used for installing an electrical-wiring cover 80 and then installing a fluorescent lamp 81 further on the wiring cover 80.

Since those divisional frame units 5 are prefabricated with accuracy at a factory and then aligned one by one in the clean room 1 to form the ceiling frame 7, the dimensional accuracy of positioning in the construction is greatly improved, so the blower units 8, etc., can be easily positioned and also sealed effectively without any dimensional errors in their placement.

Figure 14:
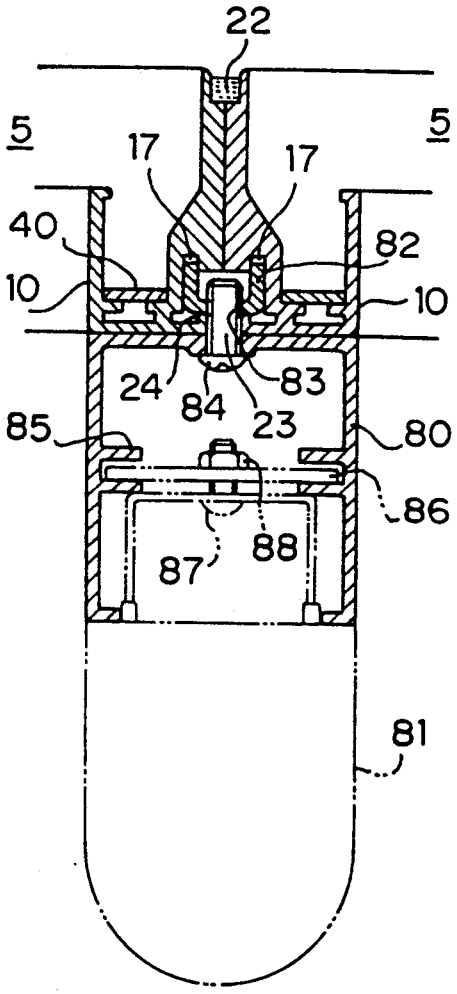
FIG. 14 is an enlarged sectional view showing the condition that a fluorescent lamp is installed on the ceiling frame according to the present invention.

FIG. 14 shows an example of the installation of a wiring cover 80 and fluorescent lamp 81 at the lower portion of the abutting frame members 10.

This example will be described in more detail with reference to FIGS. 13 and 14.

When the divisional frame units 5 are assembled, the joint pieces 30, each of which has a shape of the letter "H", are fitted into the connection grooves 17 in the abutting frame members 10. Along with those joint pieces 30, a plurality of hooks 82, each of which has a sectional figure of the letter "U", are also provided in the connection grooves 17 during the assembly of the ceiling frame 7 as seen in FIGS. 13 and 14. This hook 82 seats itself on obtrusions 24 formed at the bottom-plate portions 14, engages the connection grooves 17, and has a threaded hole 83 positioned to be exposed through the space between the obtrusions 24 of the abutting frame members 10.

In fixing installations such as fluorescent lamps 81 at the lower portion of the frame members 10, the above mentioned threaded hole 83 of the hook 82 is utilized to receive a bolt screwed in for an installation to be fixed. More specifically, as seen in FIG. 14, when a fluorescent lamp 81 is to be installed, at first, the wiring cover 80 of a box type opening downwards is placed on the frame members 10. An attaching screw 84 is applied, inside the wiring cover 80, into the threaded hole 83 of the hook 82 to fix the wiring cover 80. When the screw is to be applied, the position of the hook 82, because of the hook 82 freely slidable in the connection grooves 17, is adjusted freely to that of the attaching screw 84 applied to fix the wiring cover 80.

After the wiring cover 80 is installed, a plate 86 is inserted into the holder grooves 85 provided in the wiring cover 80. A fluorescent lamp 81 is then fixed to the plate 86 with a bolt 87 and nut 88.

Figure 13:
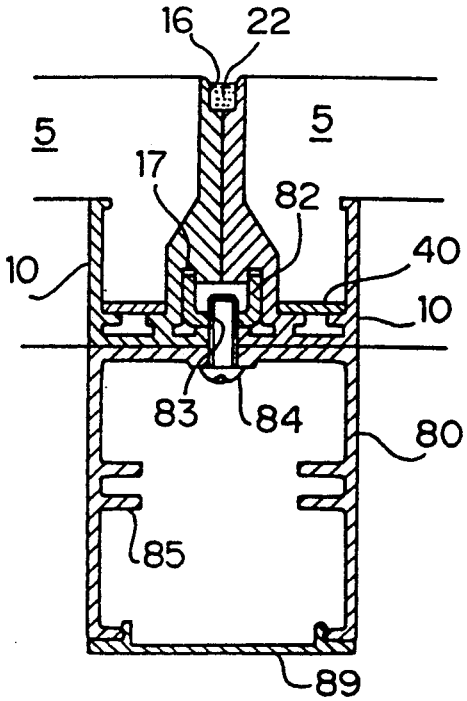
FIG. 13 is an enlarged sectional view showing the condition that an electrical-wiring cover is installed on the ceiling frame according to the present invention.

The opening of the wiring cover 80 except where fluorescent lamps 81 are placed is closed with a lid 89 as seen in FIG. 13.

With the hooks 82 having been already inserted in the connection grooves 17 at the time of the assembly of the frame members 10 as described above, it is possible for fixtures such as fluorescent lamps to be installed easily.

What is claimed is:

1. A ceiling frame structure to support a filter at a ceiling of a clean room, comprising:

a plurality of divisional frame units, each unit formed in a rectangle and at least one unit to frame a filter unit to be installed and each unit having abutting surface on its outer periphery;

a connection groove having a configuration formed in the abutting surfaces of the divisional frame unit;

a plurality of joint pieces having a configuration which interlocks with said connection groove to connect and unify said plurality of divisional frame units by engaging in the connection grooves of abutting divisional frame units when the divisional frame units are positioned next to one another; and a hanger to hang the connected divisional frame units at their corners from the ceiling.

2. The ceiling frame structure as set forth in claim 1, wherein the divisional frame unit is formed of four frame members connected in a rectangular figure, each frame member having a sectional figure approximating letter "L" and having a supporting-plate portion with the abutting surface, a bottom-plate portion extending from the support-plate portion inwards to support the filter unit, and an inside-plate portion protruding upwards from the bottom-plate portion, and the connection groove is formed contiguous to the support-plate portion and the bottom-plate portion to engage the joint piece having a sectional figure approximating letter "H" when the divisional frame units are abutted to be connected.

3. The ceiling frame structure as set forth in claim 2, wherein the connection groove is formed continuously along the frame member so that the joint piece is inserted along a longitudinal direction of the connection groove and engages the connection groove.

4. The ceiling frame structure as set forth in claim 2, wherein both ends of the bottom-plate portion of the frame member are cut off so that the frame member is formed to have adjoining portions which are adjoined and connected with other frame members to form a rectangular frame.

5. The ceiling frame structure as set forth in claim 4, wherein the frame member has an engagement groove defined above the bottom-plate portion with a pair of nail strips facing each other, one nail strip formed on the support-plate portion and the other on the inside-plate portion, with both the support-plate portion and the inside-plate portion being facing each other on the bottom-plate portion, so that the engagement groove with a "L"-shaped clip inserted into it connects the frame member with another frame member adjoined.

6. The ceiling frame structure as set forth in claim 5, wherein the "L"-shaped clip is provided with tabs protruding therefrom to prevent the clip from sliding out from the engagement grooves.

7. The ceiling frame structure as set forth in claim 2, wherein a seal groove is formed at an upper portion of the support-plate portion of the frame member to seal the frame members of abutting divisional frame units.

8. The ceiling frame structure as set forth in claim 7, wherein the seal grooves of the abutting divisional frame units are filled with a sealing agent.

9. The ceiling frame structure as set forth in claim 1, wherein the hanger includes a turnbuckle to hang the divisional frame units freely adjusting their height.

10. The ceiling frame structure as set forth in claim 9, wherein the hanger is provided with a hanger body formed with fixed plates connected in a cross, each fixed plate having a sectional figure of inverted "L", and with a removable joint placed to face each fixed plate and connected to it to bind between them the support-plate portions of abutting frame members.

11. The ceiling frame structure as set forth in claim 9, wherein the hanger is provided with a hanger body formed with fixed plates connected in a "T" shape, each fixed plate having a sectional figure of inverted "L", and with a removable joint placed to face each fixed plate and connected to it to bind between them the support-plate portions of abutting frame members.

12. The ceiling frame structure as set forth in claim 9, wherein the hanger is provided with a hanger body formed with fixed plates connected in a "L" shape, each fixed plate having a sectional figure of inverted "L", and with a removable joint placed to face each fixed plate and connected to it to bind between them the support-plate portions of abutting frame members.

13. A structure for fixing installations such as fluorescent lamps at a lower portion of a ceiling frame which supports a filter used for a clean room, comprising:

a divisional frame unit formed in a rectangular frame to frame a filter unit to be installed and positioned at and hanged from a ceiling in plurality to form the ceiling frame;

a connection groove formed at a lower portion of each frame member of the divisional frame unit, to receive a joint piece to connect the divisional frame unit with other divisional frame units;

a hook to be engagingly fitted into the connection grooves of abutting frame members of the divisional frame units aligned to make up the ceiling frame; and a cover placed at a lower portion of the abutting frame members and fixed, through the hook, to support installations such as fluorescent lamps.

14. The structure for fixing installations to the ceiling frame as set forth in claim 13, wherein the connection grooves of the abutting frame members are formed with a space between the abutting frame members so that the cover is connected through the space to the hook by means of a bolt and nut.

15. The structure for fixing installations to the ceiling frame as set forth in claim 14, wherein the cover has an opening at its lower portion, and, through the opening, a fluorescent lamp is inserted and installed.

16. The structure for fixing installations to the ceiling frame as set forth in claim 15, wherein a means to fix the fluorescent lamp is provided inside the cover.

17. The structure for fixing installations to the ceiling frame as set forth in claim 16, wherein the means to fix the fluorescent lamp comprises an engagement groove to engage a support plate to support the fluorescent lamp.

18. The structure for fixing installations to the ceiling frame as set forth in claim 13, wherein electrical wiring is accommodated in the cover.

19. A method of constructing a ceiling frame to support a filter at a ceiling of a clean room, comprising the steps of:

forming a number of divisional frame units, each in a rectangular frame to frame a filter unit;

forming the ceiling frame by aligning those divisional frame units one after another at the ceiling of the clean room and connecting via configured grooves in said frames with corresponding configured connectors, to unify, a pair of abutting frame members of the divisional frame units; and hanging the divisional frame units at the ceiling with hangers applied at abutting portions of the divisional frame units.

20. The method of constructing the ceiling frame as set forth in claim 19, wherein the method further comprises the steps of grouping and aligning a predetermined number of divisional frame units and applying the hangers at abutting portions of the divisional frame units so that a group of divisional frame units are hanged at the ceiling at a time, thus repeating those steps to complete the ceiling frame.

21. The method of constructing the ceiling frame as set forth in claim 20, wherein the method further comprises the step of fitting a blower unit into each divisional frame unit after the divisional frame units are fixed at the ceiling of the clean room.

* * * * *